US008256650B2

(12) United States Patent
Sokol

(10) Patent No.: US 8,256,650 B2
(45) Date of Patent: Sep. 4, 2012

(54) EXTENDIBLE GARMENT HANGER

(76) Inventor: Chad Sokol, Clearfield, UT (US)

( * ) Notice: Subject to any disclaimer, the term of this patent is extended or adjusted under 35 U.S.C. 154(b) by 22 days.

(21) Appl. No.: 12/587,011

(22) Filed: Sep. 29, 2009

(65) Prior Publication Data

US 2011/0073626 A1 Mar. 31, 2011

(51) Int. Cl.
*A41D 27/22* (2006.01)

(52) U.S. Cl. ..... 223/94; 223/89

(58) Field of Classification Search ..... 223/85, 223/89, 90, 93, 94, 98
See application file for complete search history.

(56) References Cited

U.S. PATENT DOCUMENTS

| | | | | |
|---|---|---|---|---|
| 1,114,294 | A | 10/1914 | Routstone | |
| 2,335,285 | A | 11/1943 | Kinney | |
| 2,354,099 | A | 7/1944 | Bess | |
| 2,446,312 | A | 8/1948 | Usina | |
| 2,477,873 | A | 8/1949 | Hopkins et al. | |
| 2,488,219 | A | 11/1949 | Miller | |
| 2,491,836 | A | 12/1949 | Simmet | |
| 2,496,561 | A | 2/1950 | Saunders | |
| 2,620,102 | A | 12/1952 | Bremer | |
| 2,629,525 | A | 2/1953 | Peterson | |
| 2,814,426 | A * | 11/1957 | Miller | 223/94 |
| 3,874,572 | A * | 4/1975 | McClenning | 223/94 |
| 4,004,721 | A | 1/1977 | Ross | |
| 4,334,641 | A * | 6/1982 | Narcum | 223/94 |
| 4,717,053 | A * | 1/1988 | Wang | 223/94 |
| 5,022,571 | A * | 6/1991 | Blanchard | 223/85 |
| 5,052,599 | A | 10/1991 | Platti | |
| 5,082,152 | A * | 1/1992 | Chen | 223/89 |
| 5,085,358 | A | 2/1992 | Lam | |
| 5,145,098 | A * | 9/1992 | Tung | 223/94 |
| 5,344,054 | A | 9/1994 | Nutter | |
| 5,476,199 | A | 12/1995 | Halverson et al. | |
| 5,598,957 | A | 2/1997 | Bell | |
| 5,718,358 | A * | 2/1998 | Long et al. | 223/94 |
| 5,979,721 | A * | 11/1999 | Curtis | 223/94 |
| 6,068,166 | A | 5/2000 | Kilian et al. | |
| 6,076,716 | A * | 6/2000 | Reyes | 223/94 |
| 6,164,504 | A | 12/2000 | Richard | |
| 6,173,871 | B1 * | 1/2001 | Woodworth | 223/94 |
| 6,179,174 | B1 | 1/2001 | Kandl | |
| 6,409,058 | B1 | 6/2002 | Lam et al. | |
| 6,672,491 | B1 * | 1/2004 | Gugler | 223/89 |
| 6,688,503 | B2 * | 2/2004 | Viazanko et al. | 223/89 |
| 6,722,538 | B1 | 4/2004 | Autry et al. | |

(Continued)

FOREIGN PATENT DOCUMENTS

EP 1459661 A1 * 9/2004

*Primary Examiner* — Nathan Durham
(74) *Attorney, Agent, or Firm* — Bateman IP

(57) ABSTRACT

An extendible garment hanger for clothing items having shoulders of differing widths is provided. The garment hanger includes a body having an upright hook from which a pair of shoulder supports are oppositely laterally downwardly dependent. A pair of extension arms each include a slide section slidably mounted along one of the shoulders supports in a slide bore. The extension arms each have a proximal end with an upright finger tab or loop and a distal end with a downwardly curved end support. The extension arms are manually positionable in a plurality of longitudinal positions along the shoulder supports such that the end supports fit the width of the clothing item. Additionally, the garment hanger may include a clothing support that interconnects the shoulder supports and/or one or more clothing hooks.

26 Claims, 16 Drawing Sheets

U.S. PATENT DOCUMENTS

Figure 1:
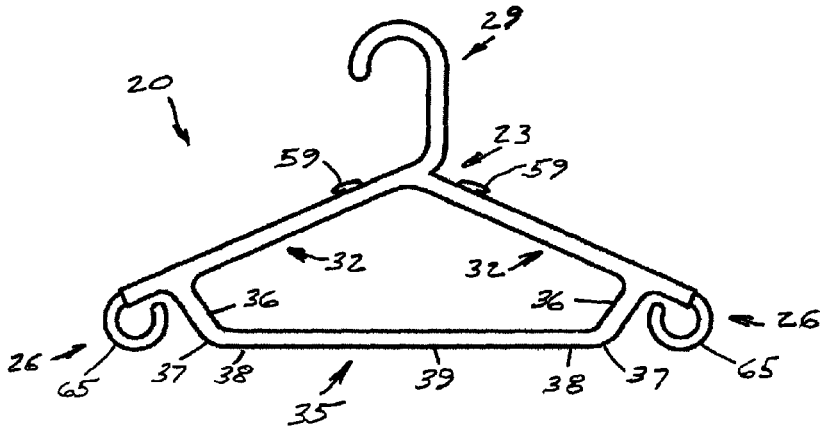

| | | | | |
|---|---|---|---|---|
| 6,758,378 | B2 * | 7/2004 | Carmichael | 223/85 |
| 7,077,300 | B1 | 7/2006 | Di Pietro | |
| 7,097,081 | B2 | 8/2006 | Frassinelli | |
| 7,246,729 | B2 | 7/2007 | Harvey | |
| 7,270,252 | B2 | 9/2007 | Hunt et al. | |
| 7,328,822 | B2 | 2/2008 | Stokes | |
| 2002/0056735 | A1 | 5/2002 | Lam | |
| 2004/0016779 | A1 | 1/2004 | Salem | |
| 2008/0257920 | A1 | 10/2008 | Spencer | |
| 2009/0120974 | A1 | 5/2009 | Rossaki | |

* cited by examiner

EXTENDIBLE GARMENT HANGER

BACKGROUND OF THE INVENTION

1. Field

The present invention generally relates to garment and clothes hangers for storing clothing items in a wrinkle-free manner, and more particularly to such garment and clothes hangers that are extendible to fit clothing items of different sizes having different shoulder widths.

2. State of the Art

Coat hangers or garment hangers (hereinafter both referred to as garment hangers) are used in a variety of applications to maintain clothing articles in a non-wrinkled condition during storage and transport. Garment hangers facilitate the storage of clothing within wardrobes and to display clothing in retail shops. Garment hangers are available in a variety of constructions and sizes depending on the type and size of the clothing article.

Clothing articles obviously have different dimensions to fit to the size of the wearer according to age and physical build. Shirts, jackets, sweaters, coats, blouses, and some dresses all have seams that connect the sleeves to the torso section of the clothing article. A garment hanger that incorrectly fits the shoulder width of the clothing article ends either on the shoulders or on the sleeves of the clothing article leaving unsightly wrinkles or stretch deformities. A garment hanger that properly fits to the and support the shoulder with terminates at the seam (a reinforced portion of the garment) thereby preventing any wrinkles or stretch deformities.

Although fixed length hangers may properly fit the shoulder size of some clothing articles, very few clothing items even of the same size have seams in the same place. It is therefore desirable to have garment hangers that are adjustable to fit the various shoulder sizes.

Various garment hangers have been patented that attempt to solve the problem of fitting clothing items of different sizes. For example, in U.S. Pat. No. 5,052,599 issued to Platti on Oct. 1, 1991 an adjustable garment hanger is disclosed. The hanger includes an upright hook and a pair of divergent shoulder bars interconnected by a crossbar. A pair of adjustable shoulder tubes each have an open bottom channel so as to snap-fit over respective of the shoulder bars. The shoulder tubes are frictionally positionable along the shoulder bars in a plurality of desired longitudinal positions. Shoulder width of the hanger is changeable by the extension or retraction of the shoulder tubes to accommodate a variety of garment sizes with various shoulder widths.

In U.S. Pat. No. 6,722,538 issued to Autry, et al. on Apr. 20, 2004 is disclosed an adjustable clothes hanger that includes a swivelable, upright hook connected to a pair of divergent shoulder tubes, a cross-tube, and a pair of U-shaped end tubes that telescopically engage the shoulder and cross-tubes. A series of spring-loaded pushbuttons or snap fasteners engage a series of holes in the tubes to removably lock the end tubes in a plurality of desired longitudinal positions. The hanger allows hanging of larger sized shirts, blouses, jackets, coats, and the like without allowing shoulder sections of the garments to sag.

The prior art adjustable garment hangers have a multitude of serious shortcomings. Firstly, they tend not to be rigid and sturdy enough to hold heavier clothing articles such as sweaters. Secondly, they tend to be expensive to manufacture. Thirdly, they do not smoothly engage the clothing article and create wrinkles and deformities. Fourthly, they do not allow hanging up of additional clothing articles such a brasiers, ties, belts, pants, and the like. Fifthly, they do not retain the desired position to fit the shoulder width of the clothing article. There is a need for an improved adjustable garment hanger that solves the shortcomings in the prior art garment hangers.

SUMMARY OF THE INVENTION

The present invention is an extendible garment hanger for clothing items having shoulders of differing widths. The garment hanger includes a body having an upright hook from which a pair of shoulder supports are oppositely laterally downwardly dependent. A pair of extension arms each include a slide section slidably mounted along one of the shoulder supports. The extension arms each have a proximal end with an upright finger tab and a distal end with a downwardly curved end support. The extension arms are manually positionable in a plurality of longitudinal positions along the shoulder supports by moving the finger tabs such that the end supports fit the width of the clothing item.

In a first type of the garment hangers, the body is made of plastic and includes a clothing support that interconnects the shoulder supports. Each shoulder support has a slide bore and an adjoining tab slot along which a plurality of tab-receiving detents or spaced holes are disposed. The extension arms are of a plastic or bent wire construction with the slide sections being of circular, oval, or polygonal cross-section. Each slide section is closely slidably receivable within the slide bore of one of the shoulder supports. The extension arms are positionable in a finite plurality of the longitudinal positions by moving the finger tabs along the slide bores into the tab-receiving detents or respective locking tips of the slide sections into the holes.

In a first embodiment garment hanger of the first type, the body is integrally molded. The tab slots are each disposed in an upwardly or forwardly radial position. Each tab slot has an elongated main section along which the tab-receiving detents are disposed that terminates at a laterally wider distal end. The clothing support has a pair of horizontally spaced connecting sections downwardly dependent from the shoulder supports with lower ends affixed to opposite ends of a horizontally disposed support section. The extension arms are of the plastic construction with the slide sections being of the circular cross-section. The proximal end of each slide section is longitudinally tapered radially opposite the finger tab to facilitate assembly into the slide bores. The end supports comprise clothing hooks. Each finger tab has an enlarged head with a smooth, low clothing-friendly profile connected to the slide section through a laterally narrower neck. The head and the neck respectively closely fit through the distal end and the and the main section of the tab slot. A transverse slot divides each finger tab into a non-flexible proximal end and a flexible retaining tab adapted to releasably snap-lock the extension arm to the body.

In a second embodiment garment hanger of the first type, the body is integrally molded and has a centrally disposed clothing hook dependent from one of the shoulder supports. The extension arms are of the bent wire construction with the slide sections being of the circular cross-section. The finger tabs each comprise finger loop.

In a third embodiment garment hanger of the first type, the body is integrally molded. The slide sections and the finger tabs of the extension arms are of the bent wire construction with the slide sections being of the circular cross-section. The shoulder supports comprise clothing hooks of the plastic construction. The finger tabs each comprise a right-angle finger extension covered by a finger cap.

In a fourth embodiment garment hanger of the first type, the shoulder supports comprise a pair of stub arms dependent from the hook and a pair of extension tubes. Each extension tube has the slide bore into which respective of the stub arms are coaxially affixed and the tab slot along which the tab-receiving detents are disposed. The clothing support has a pair of horizontally spaced connecting sections downwardly dependent from the extension tubes with lower ends affixed to opposite ends of a horizontally disposed support section. The extension arms are of the plastic construction with the slide sections being of the circular cross-section. The end support comprises a clothing hook. The finger tab is curved.

In a second type of the garment hangers, the body is integrally molded from plastic and includes a clothing support that interconnects the shoulder supports. Each shoulder support has a slide groove and at least one retaining loop. The extension arms are of a plastic or bent wire construction, or a combination thereof with the slide sections being of circular, oval, polygonal, tee, or mushroom cross-section. Each slide section is closely slidably receivable within the slide groove of one of the shoulder supports retained therein by the retaining loop. Each finger tab comprises a finger loop or a right-angle finger extension covered by a finger cap. The extension arms are positionable in an infinite plurality of longitudinal positions along the shoulder supports using friction by moving the finger tabs along the tab slots.

In a fifth embodiment garment hanger of the second type, the body includes a pair of horizontally spaced clothing hooks dependent from respective of the shoulder supports. The extension arms are of the bent wire construction with the slide sections being of the circular cross-section. The finger tabs comprise the finger loops.

In a sixth embodiment garment hanger of the second type, the extension arms are of the plastic construction with the slide sections being of the mushroom cross-section.

THE DRAWINGS

Figure 2:
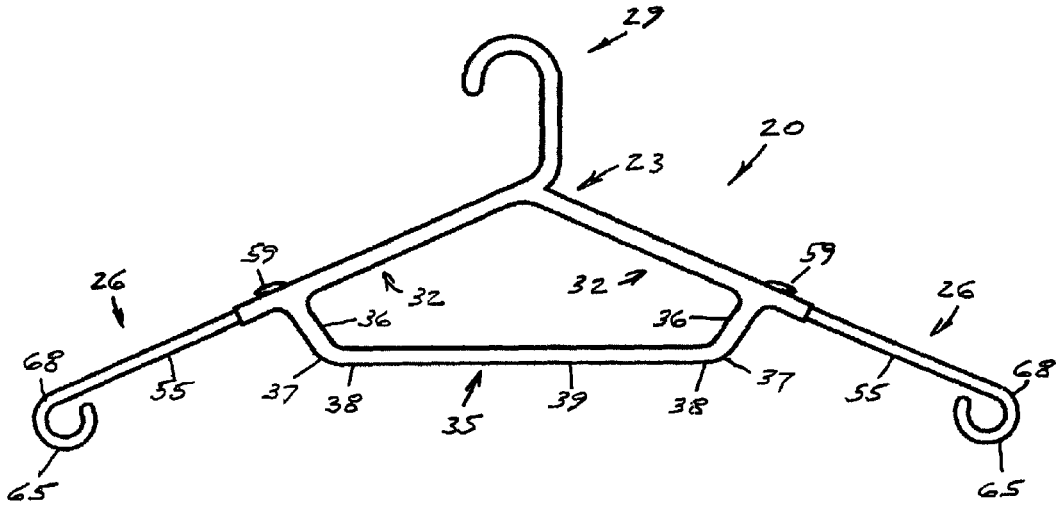
Figure 3:
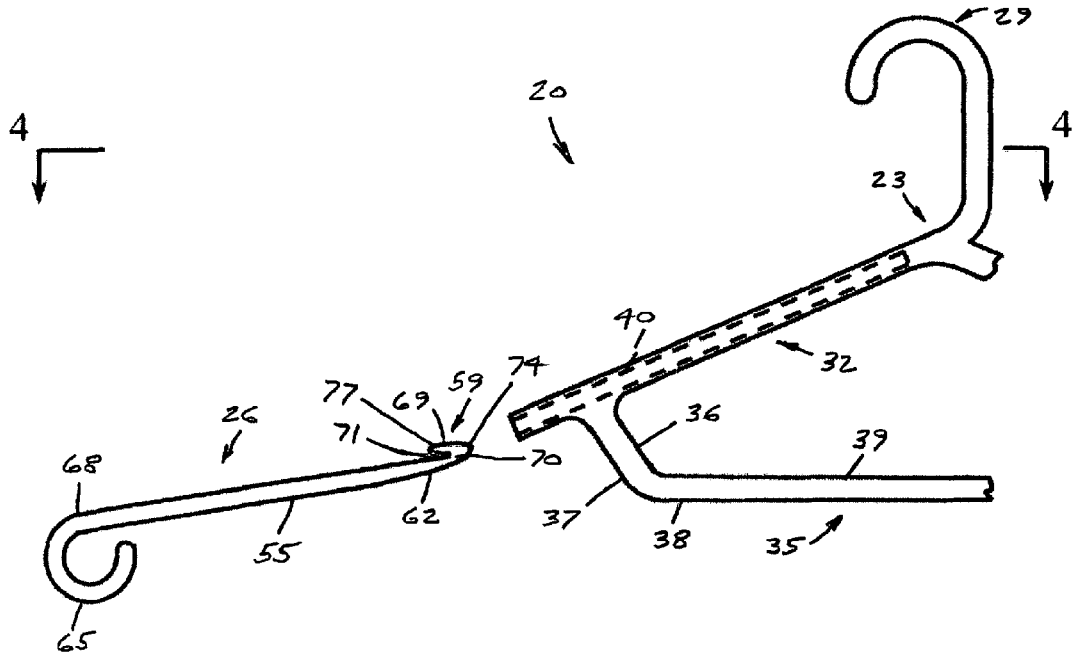
Figure 4:
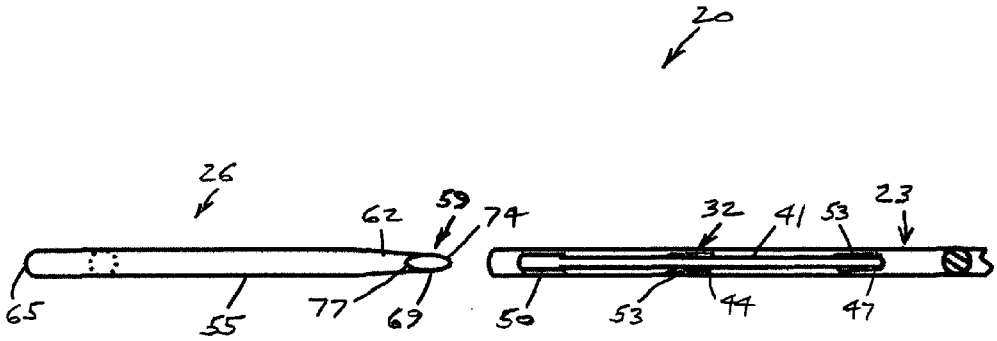
Figure 5:
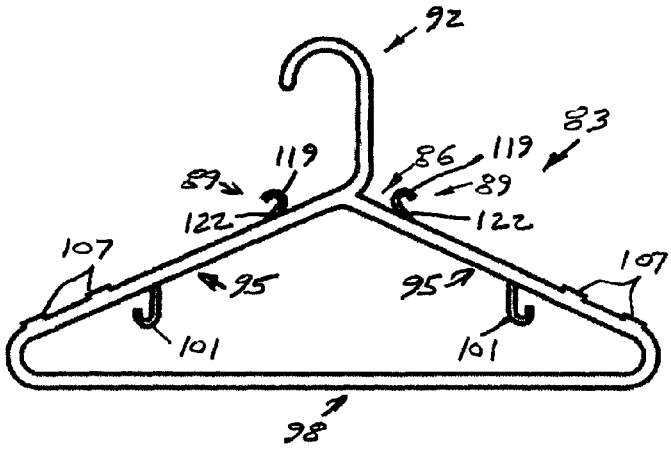
Figure 6:
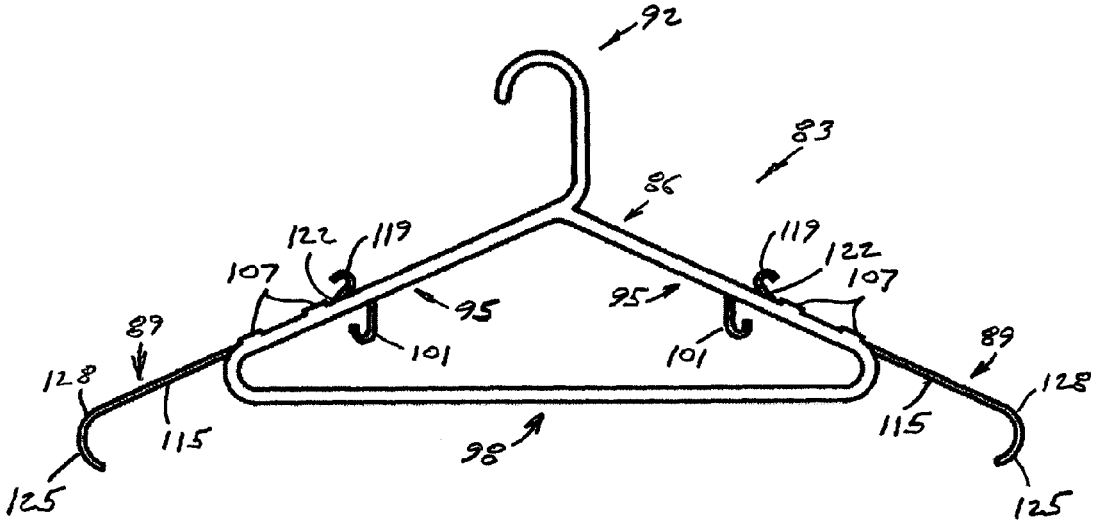
Figure 7:
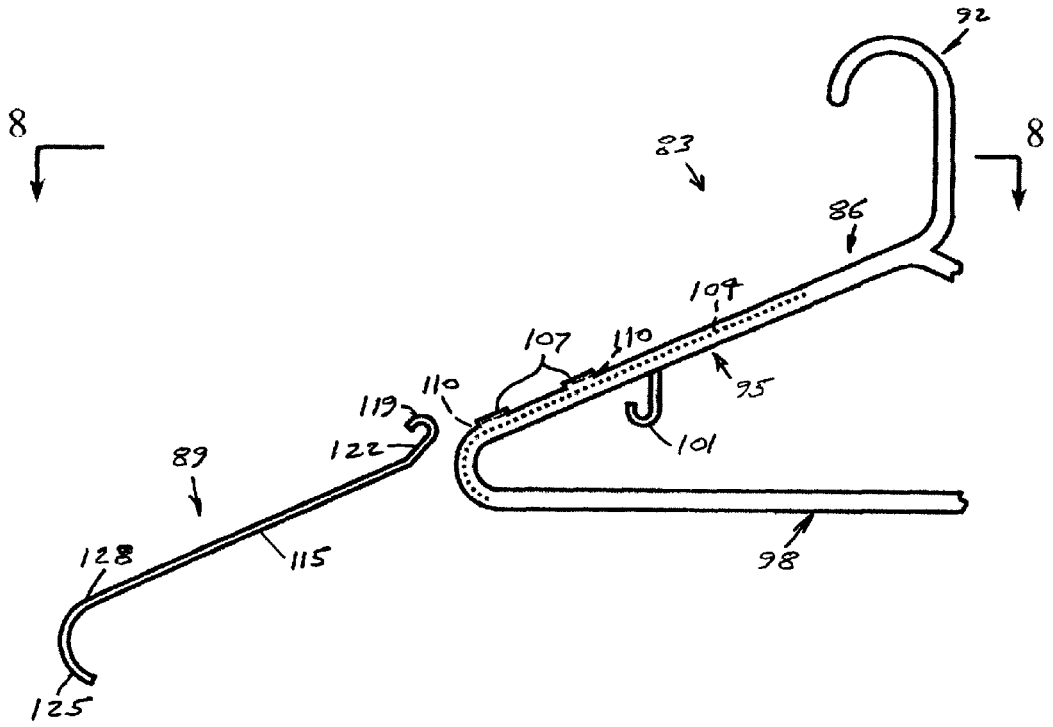
Figure 8:
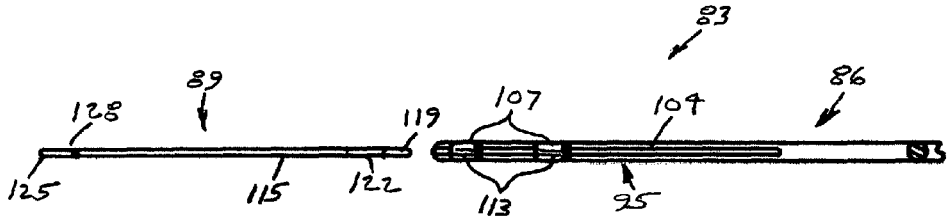
Figure 9:
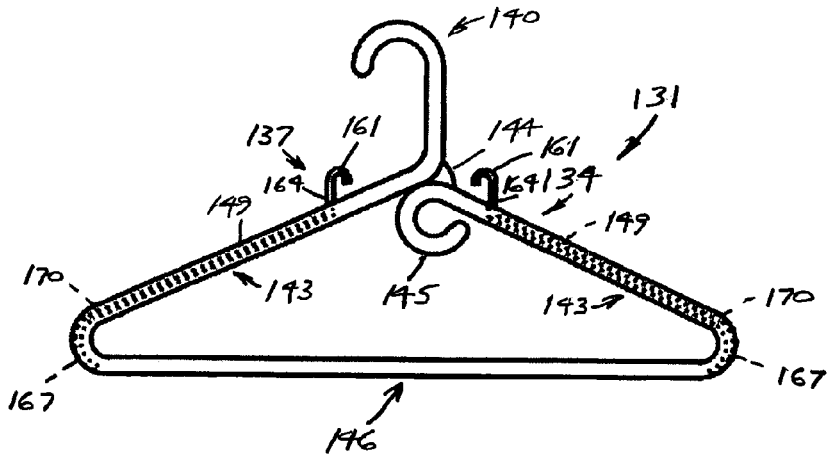
Figure 10:
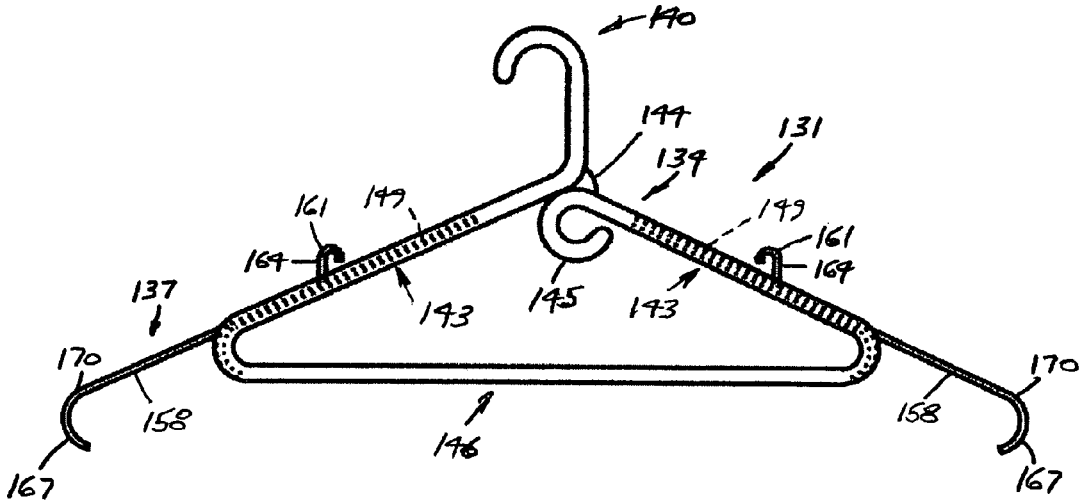
Figure 11:
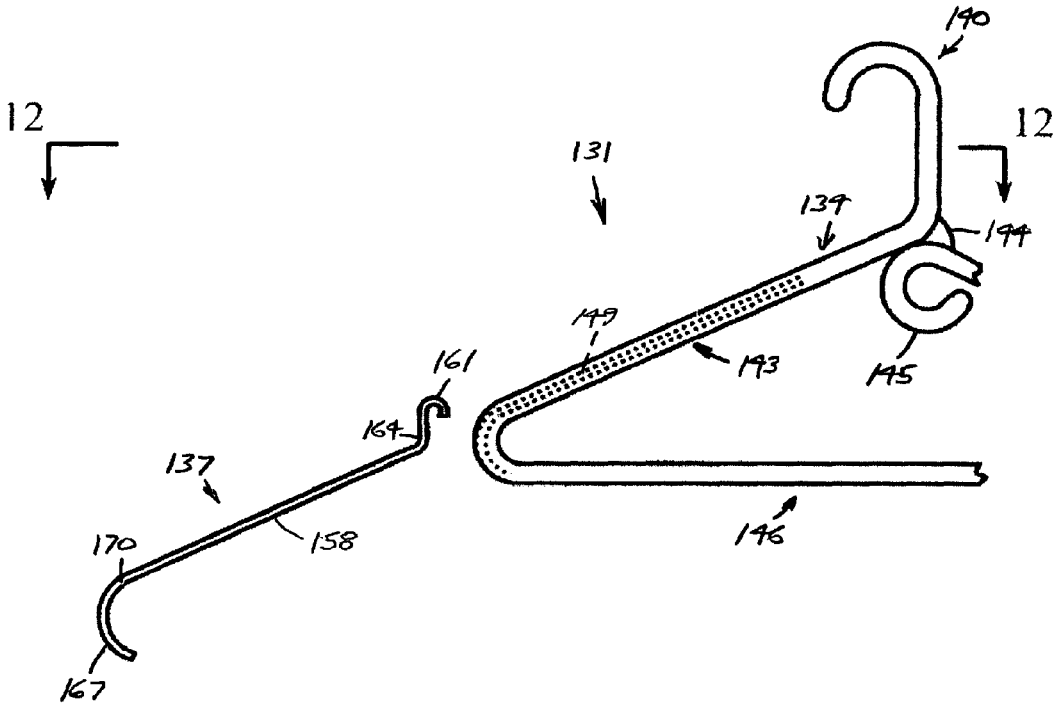
Figure 12:
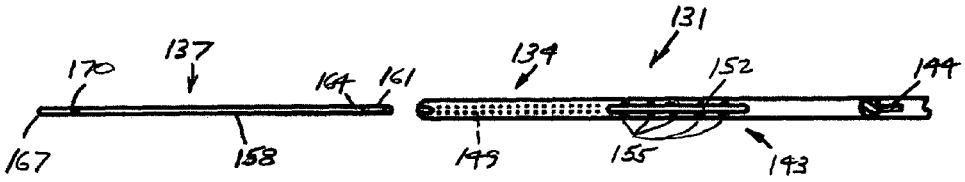
Figure 13:
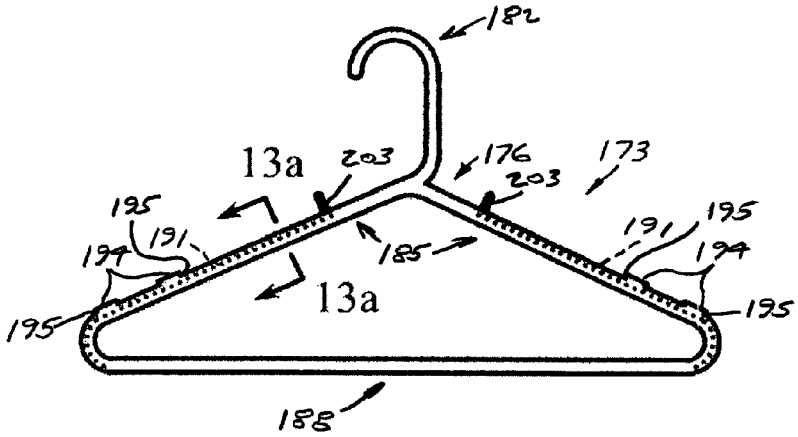
Figure 13A:
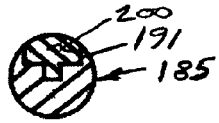
Figure 14:
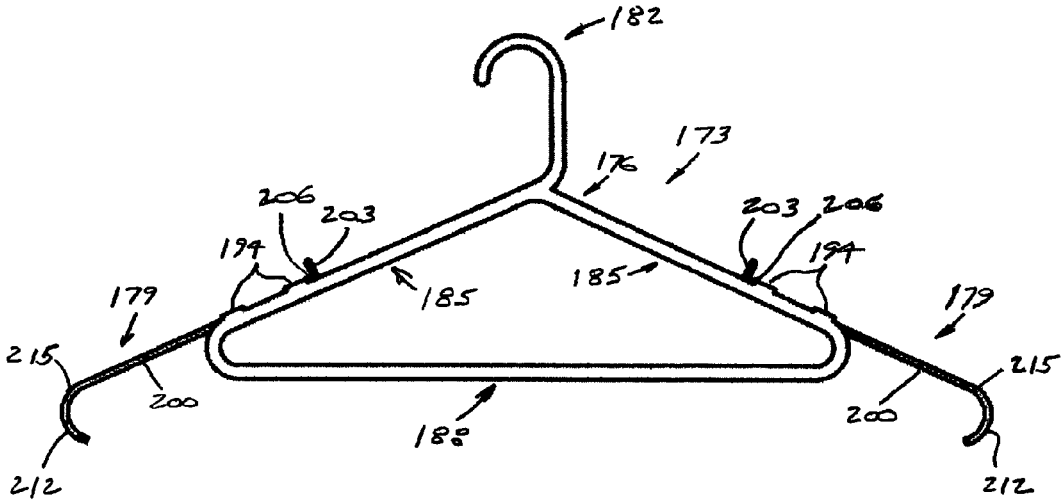
Figure 15:
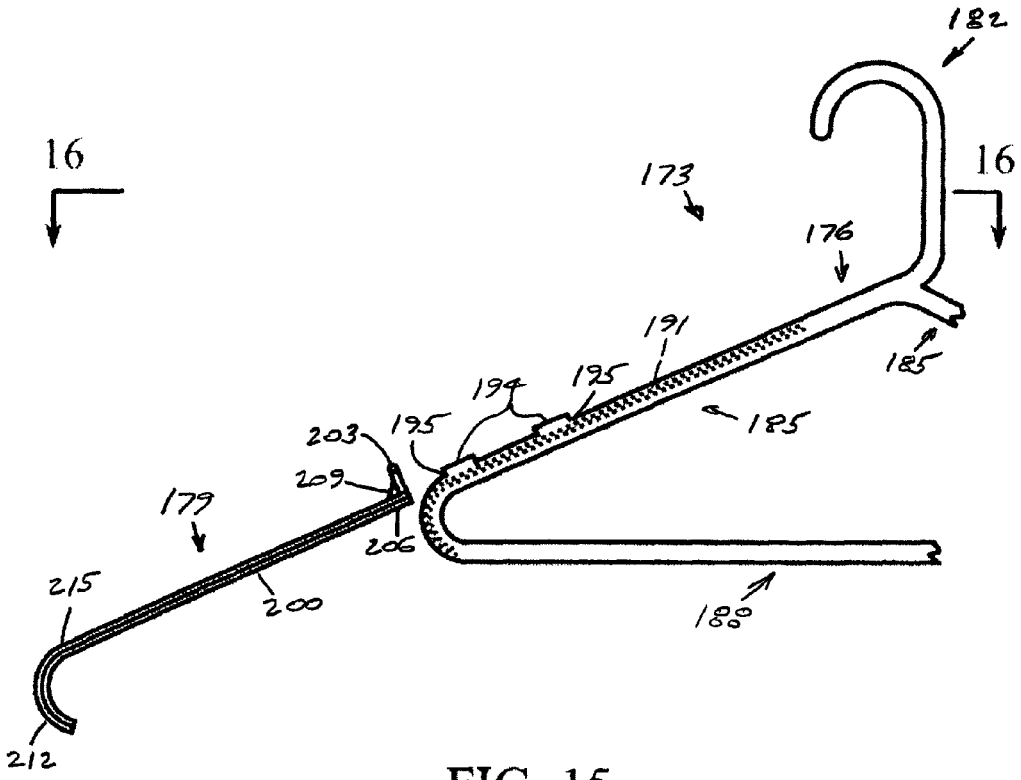
Figure 16:
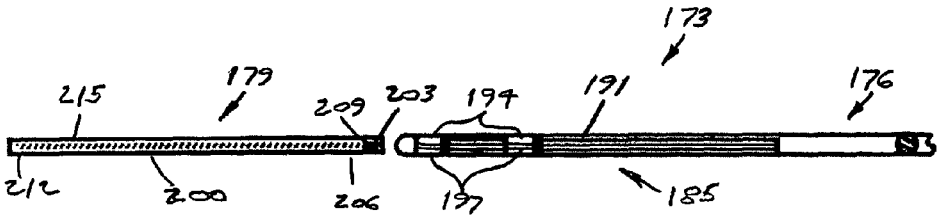
Figure 17:
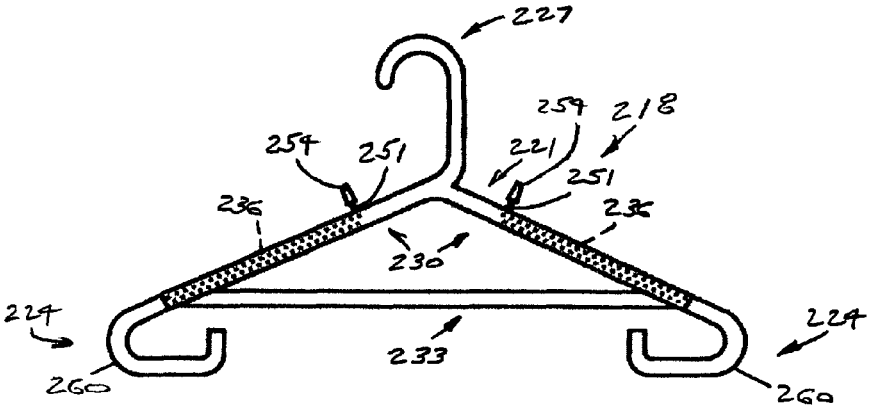
Figure 18:
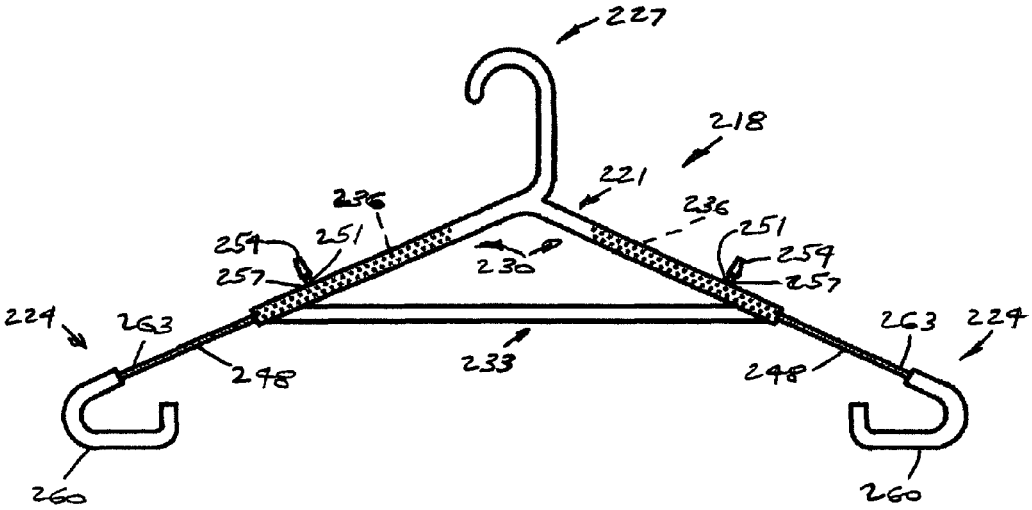
Figure 19:
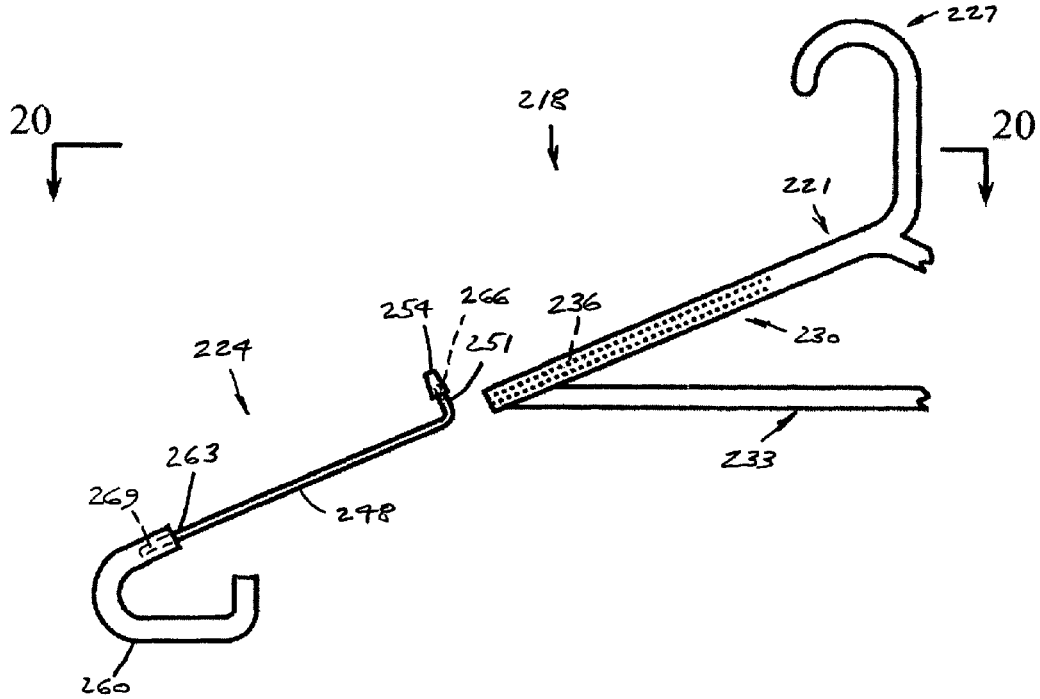
Figure 20:
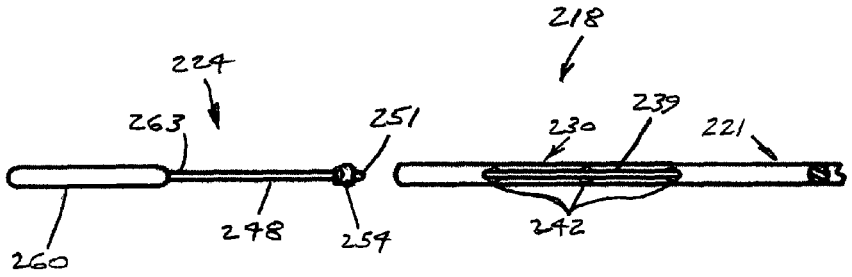
Figure 21:
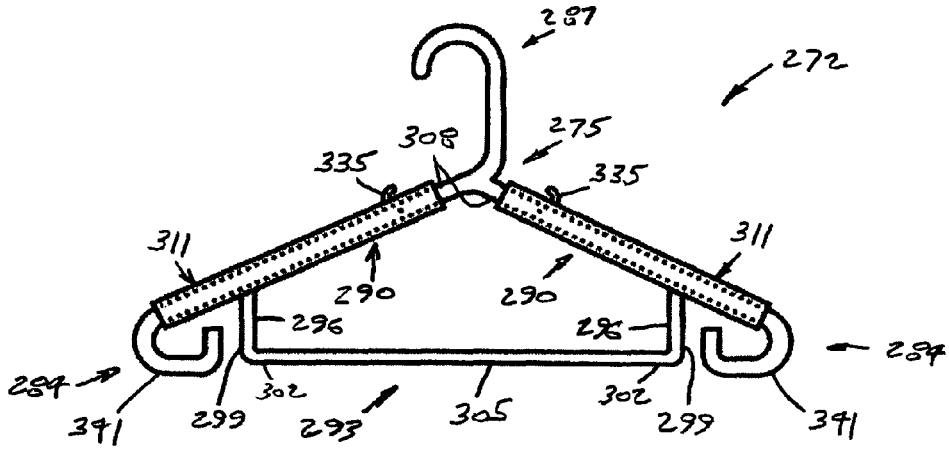
Figure 22:
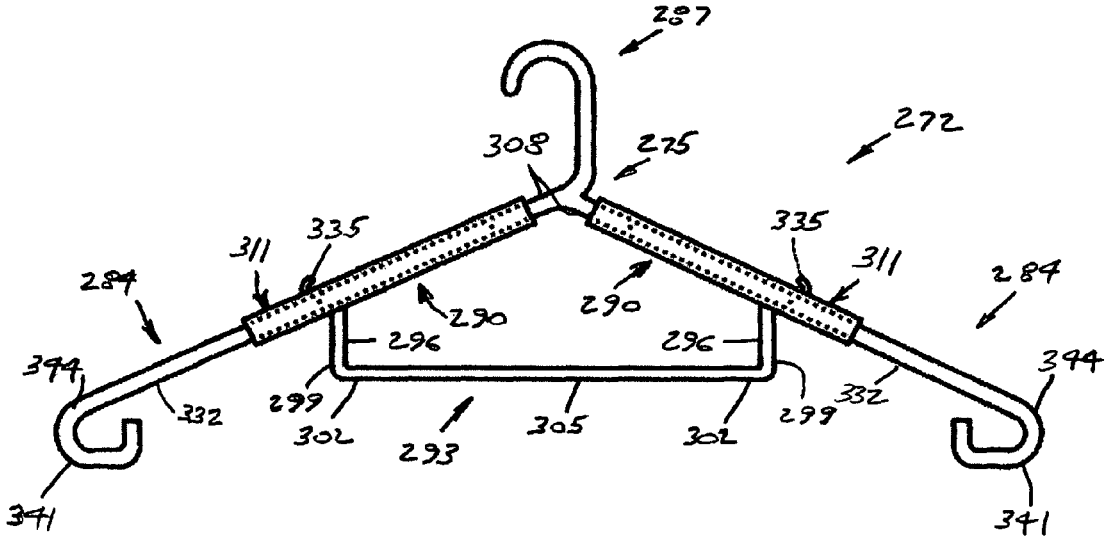
Figure 23:
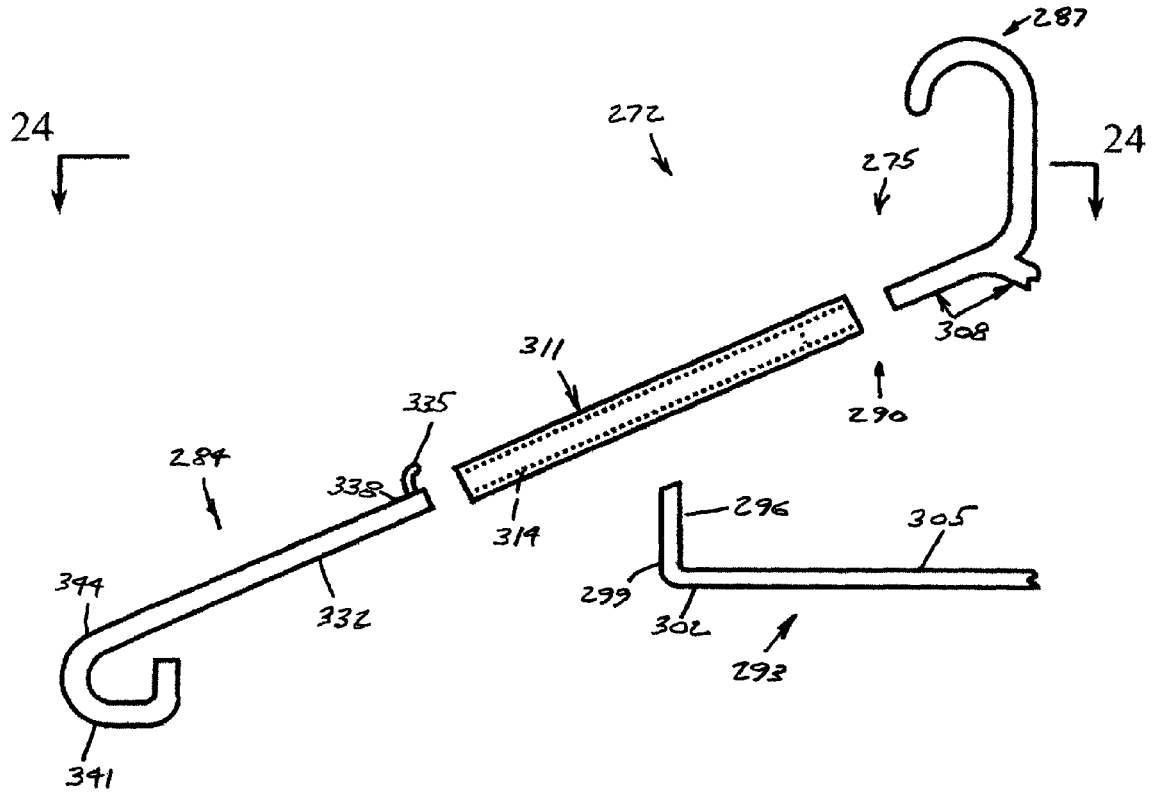
Figure 24:
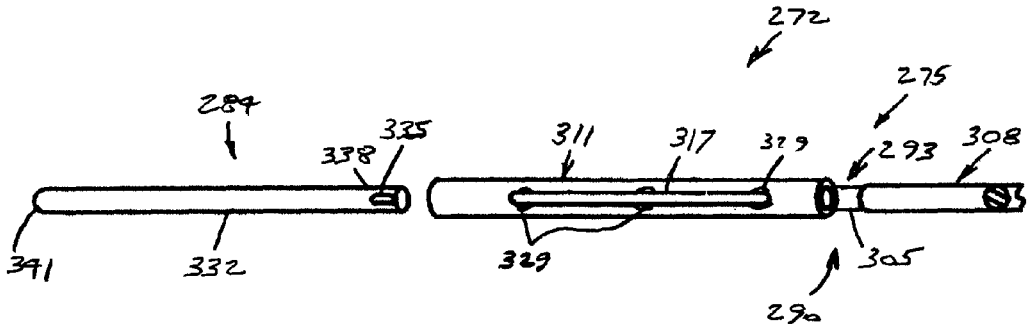
Figure 25:
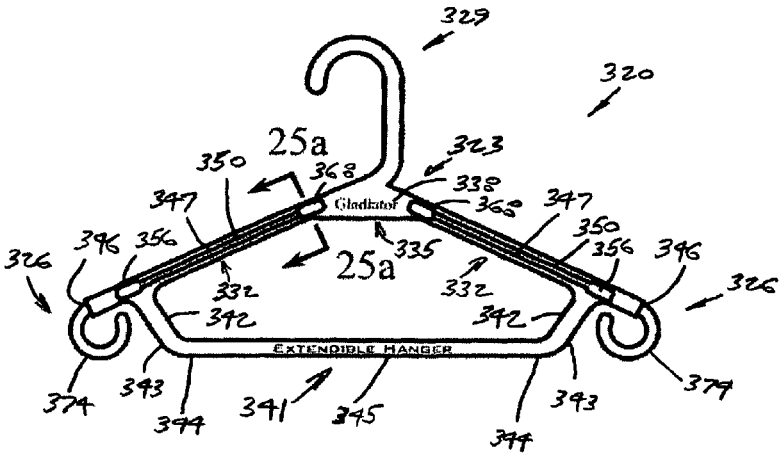
Figure 25A:
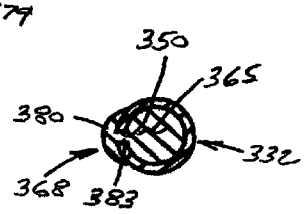
Figure 26:
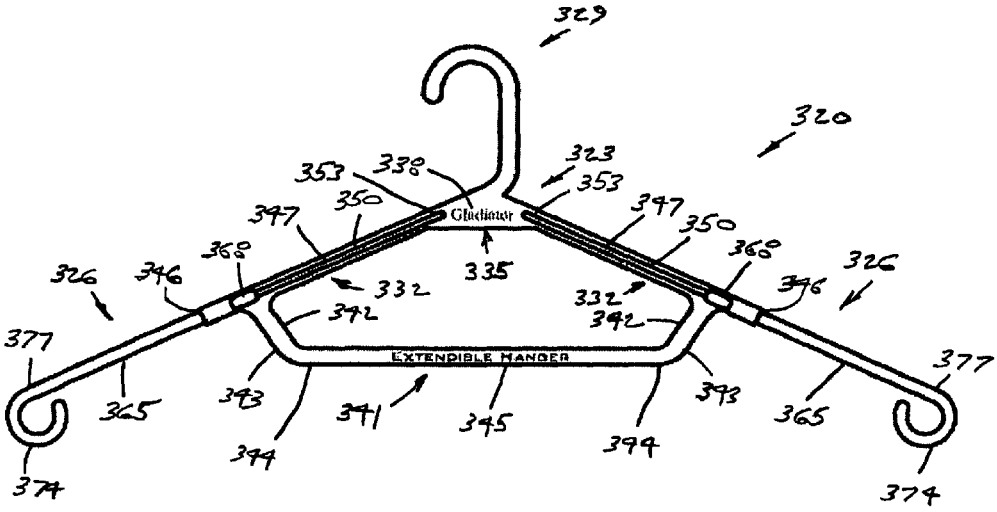
Figure 27:
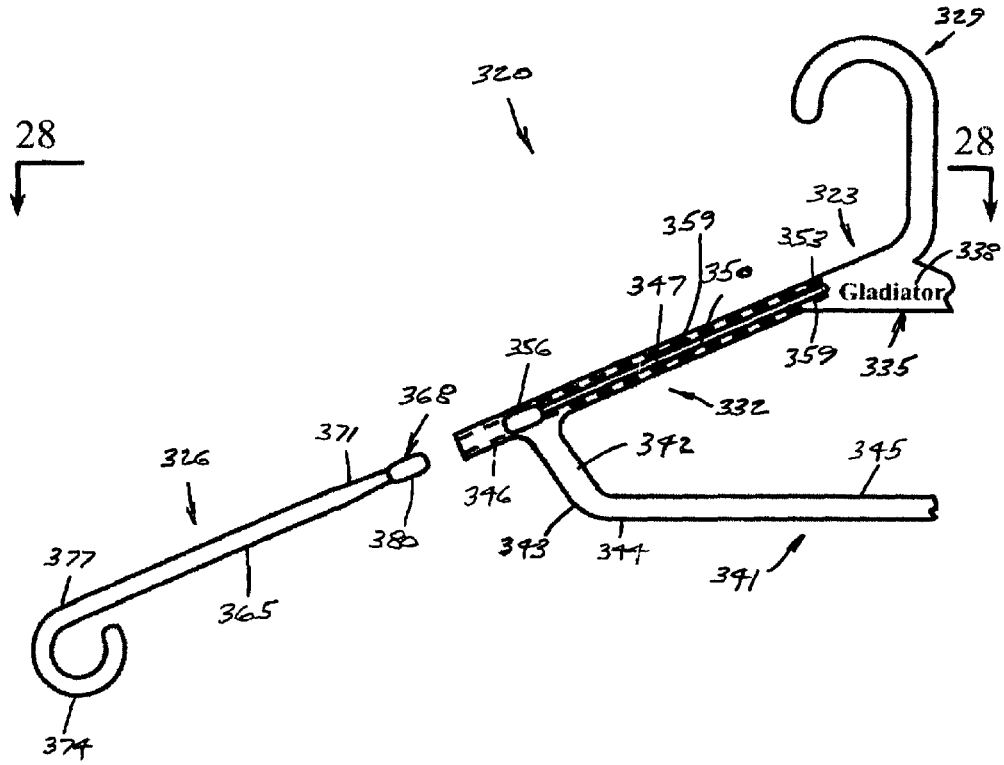
Figure 28:
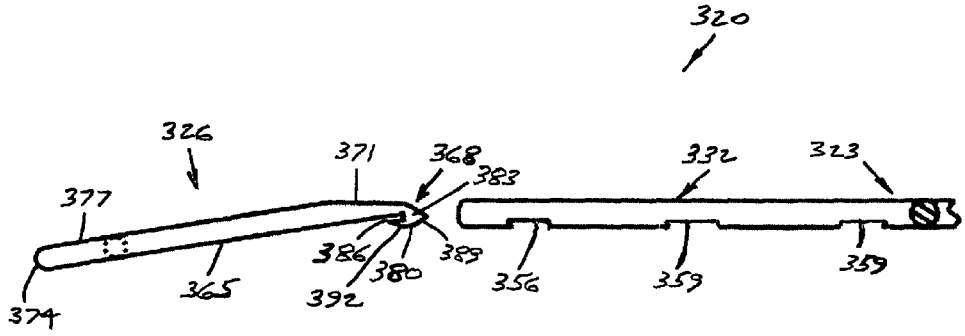
Figure 29:
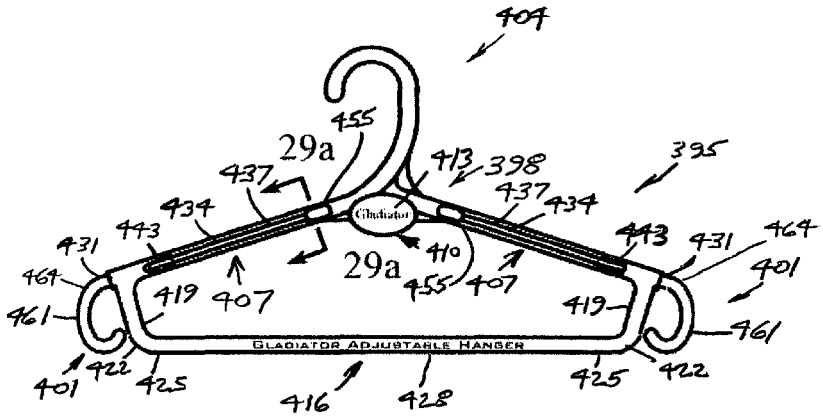
Figure 29A:
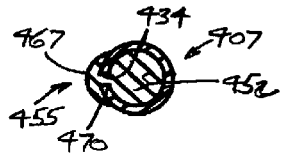
Figure 30:
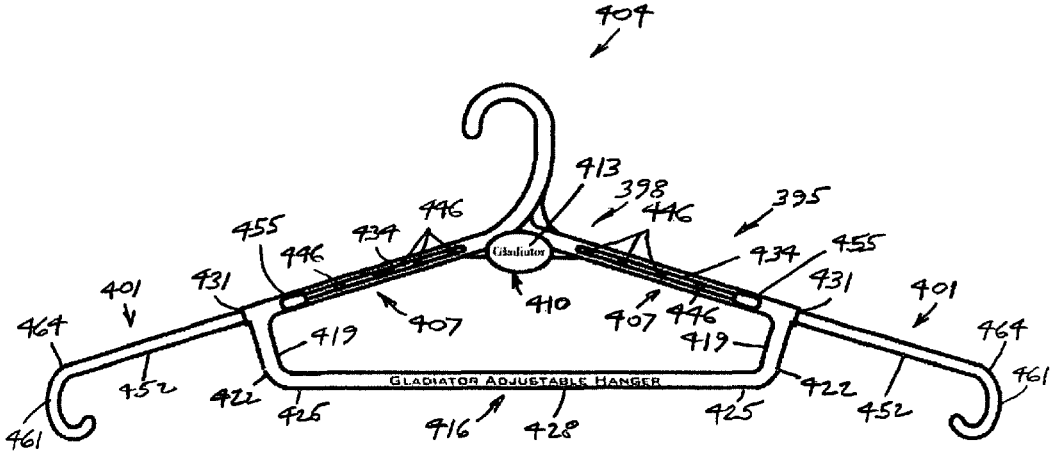
Figure 31:
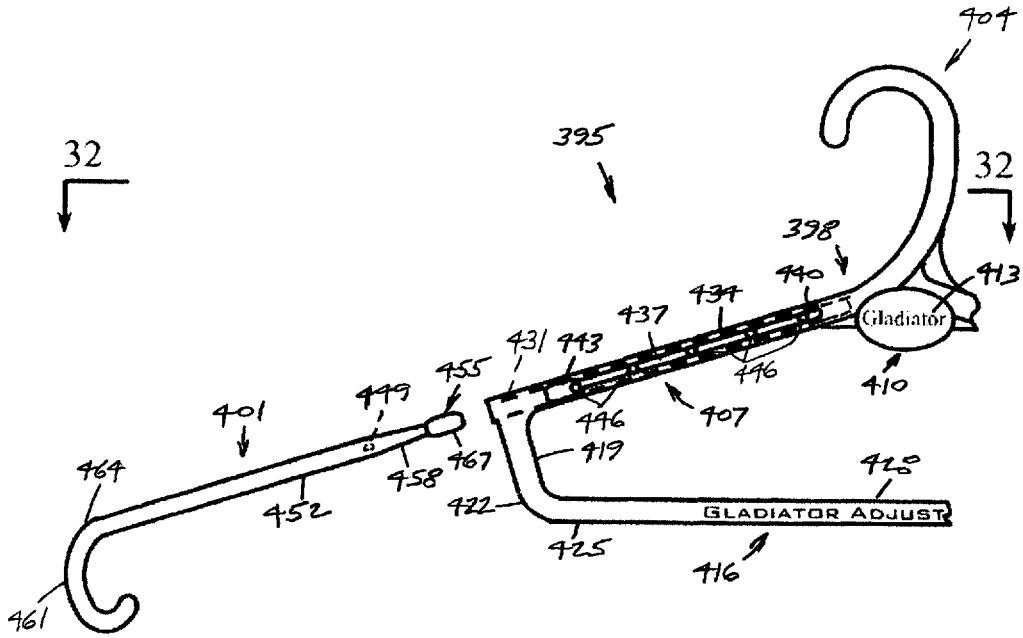

The best mode presently contemplated for carrying out the invention is illustrated in the accompanying drawings, in which:

FIG. 1 is a front elevational view of a first embodiment extendible garment hanger of the present invention that includes a body and a pair of slidable extension arms shown in respective retracted positions;

FIG. 2, a front elevational view of the garment hanger with the extension arms in respective extended positions;

FIG. 3, an exploded fragmentary view of the garment hanger;

FIG. 4, a fragmentary top plan view of the garment hanger taken on the line 4-4 of FIG. 3;

FIG. 5 is a front elevational view of a second embodiment extendible garment hanger that includes a body and a pair of slidable extension arms shown in respective retracted positions;

FIG. 6, a front elevational view of the garment hanger with the extension arms in respective extended positions;

FIG. 7, an exploded fragmentary view of the garment hanger;

FIG. 8, a fragmentary top plan view of the garment hanger taken on the line 8-8 of FIG. 7;

FIG. 9 is a front elevational view of a third embodiment extendible garment hanger that includes a body and a pair of slidable extension arms shown in respective retracted positions;

FIG. 10, a front elevational view of the garment hanger with the extension arms in respective extended positions;

FIG. 11, an exploded fragmentary view of the garment hanger;

FIG. 12, a fragmentary top plan view of the garment hanger taken on the line 12-12 of FIG. 11;

FIG. 13 is a front elevational view of a fourth embodiment extendible garment hanger that includes a body and a pair of slidable extension arms shown in respective retracted positions;

FIG. 13*a*, a lateral cross-sectional view of the garment hanger taken on the line 13*a*-13*a* of FIG. 13;

FIG. 14, a front elevational view of the garment hanger with the extension arms in respective extended positions;

FIG. 15, an exploded fragmentary view of the garment hanger;

FIG. 16, a fragmentary top plan view of the garment hanger taken on the line 16-16 of FIG. 15;

FIG. 17 is a front elevational view of a fifth embodiment extendible garment hanger that includes a body and a pair of slidable extension arms shown in respective retracted positions;

FIG. 18, a front elevational view of the garment hanger with the extension arms in respective extended positions;

FIG. 19, an exploded fragmentary view of the garment hanger;

FIG. 20, a fragmentary top plan view of the garment hanger taken on the line 16-16 of FIG. 15;

FIG. 21 is a front elevational view of a sixth embodiment extendible garment hanger that includes a body, a pair of extension tubes, a U-shaped support rod, and a pair of slidable extension arms shown in respective retracted positions;

FIG. 22, a front elevational view of the garment hanger with the extension arms in respective extended positions;

FIG. 23, an exploded fragmentary view of the garment hanger;

FIG. 24, a fragmentary top plan view of the garment hanger taken on the line 24-24 of FIG. 23;

FIG. 25, a front elevational view of a seventh embodiment extendible garment hanger that includes a body and a pair of slidable extension arms shown in respective retracted positions;

FIG. 25*a*, a lateral cross-sectional view of the garment hanger taken on the line 25*a*-25*a* of FIG. 25;

FIG. 26, a front elevational view of the garment hanger with the extension arms in respective extended positions;

FIG. 27, an exploded fragmentary view of the garment hanger;

FIG. 28, a fragmentary top plan view of the garment hanger taken on the line 28-28 of FIG. 27;

FIG. 29, a front elevational view of an eighth embodiment extendible garment hanger that includes a body and a pair of slidable extension arms shown in respective retracted positions;

FIG. 29*a*, a lateral cross-sectional view of the garment hanger taken on the line 29*a*-29*a* of FIG. 29;

FIG. 30, a front elevational view of the garment hanger with the extension arms in respective extended positions;

FIG. 31, an exploded fragmentary view of the garment hanger; and

Figure 32:
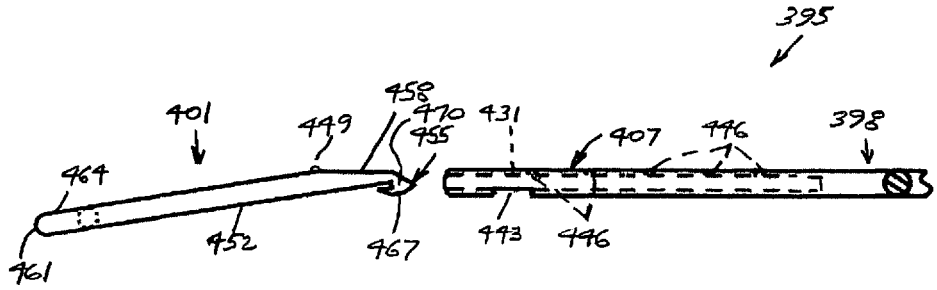

FIG. 32, a fragmentary top plan view of the garment hanger taken on the line 32-32 of FIG. 31.

DETAILED DESCRIPTION OF THE ILLUSTRATED EMBODIMENTS

Referring to FIGS. 1-4, therein is shown a first embodiment extendible garment hanger of the present invention, designated generally at 20, for hanging up clothing items (not shown) having shoulders of differing widths such as coats, shirts, dresses, jackets, and blouses. The garment hanger 20 includes a first version body 23 and a pair of slidable first version extension arms 26.

The body 23 includes an upright hook 29 from which a pair of shoulder supports 32 are oppositely laterally downwardly dependent, and a semi-U-shaped clothing support 35 downwardly dependent from and that interconnects the shoulder supports 32 all of which are preferably integrally molded together from a suitable plastic material. The clothing support 35 includes a pair of horizontally spaced connecting sections 36 downwardly dependent from the shoulder supports 32 with lower ends 37 affixed to opposite ends 38 of a horizontally disposed support section 39. The shoulder supports 32 and the clothing support 35 form a rounded, semi-triangular shape. Each shoulder support 32 has a slide bore 40 in which one extension arm 26 is closely receivable and an adjoining tab slot 41 disposed radially upwardly thereof. The slide bores 40 are preferably of a circular cross-section, though other cross-sections are possible such as oval, polygonal, tee, and mushroom. The tab slot 41 has an elongated main section 44 that extends from a proximal end 47 thereof and terminates at a laterally wider distal end 50. The extension arms 26 may be frictionally retained within the slide bores 40 to provide an infinite number of longitudinal positions along the shoulder supports 32 to optimally receive and support the clothing items of the various shoulder widths. Alternatively, a plurality of spaced detents 53 may be provided that are disposed along the tab slots 41 to retain the extension arms 26 in a finite number of predetermined longitudinal positions.

Each extension arm 26 is of a plastic construction that includes a slide section 55 that is closely receivable within the slide bore 40 of the shoulder support 32. A finger tab 59 is upwardly dependent from a longitudinally tapered proximal end 62 thereof. A curved end support in the form of a clothing hook 65 is downwardly dependent from a distal end 68 thereof. The slide section 55, the finger tab 59, and the clothing hook 65 are all preferably integrally molded together from the plastic material. The finger tab 59 has an enlarged head 69, preferably of elongated partially-flattened football shape, connected to the slide section 55 through a laterally narrower neck 70. A transverse slot 71 divides the finger tab 59 into a non-flexible proximal end 74 and a flexible retaining tab 77 that releasably snap-locks the extension arm 26 to the body 23. The finger tab 59 fits through the distal end 50 of the tab slot 41. The neck 70 of the finger tab 59 closely slidably fits within the main section 44 of the tab slot 41. The finger tab 59 is releasably retained within the detents 53 of the tab slot 41.

The extension arms 26 fit into the slide bores 38 of the shoulder supports 32 by slightly tilting the extension arm 26 slightly off of coaxial with the shoulder support 32 as shown in FIG. 3. As the finger tab 47 and the proximal end 50 of the extension arm 26 are slid into the slide bore 38 of the shoulder support 32 they move towards a coaxial orientation. However, the retaining tab 65 of the finger tab 47 prohibits further movement to the coaxial orientation until a slight longitudinally-directed hand-force is applied to the shoulder support 32 to downwardly deflect the retaining tab 77 thereof so the finger tab 47 enters the distal end 50 of the tab slot 41. This locks the extension arm 26 to the body 23. The extension arm 26 can be removed from the body 23 by manually downwardly deflecting the retaining tab 77 and reversing the procedure.

The garment hanger 20 is used like conventional, non-extendible garment hangers (not shown) except that the extension arms 26 are manually extended or retracted by moving the finger tabs 59 to the infinite number of longitudinal positions or to the predetermined positions as determined by the detents 53 to such that the clothing hooks 65 fit the width of the clothing item (at a widest part of an inside shoulder area of the clothing item). Another clothing item (not shown) such as a tie, a brassier, or the like can be hung from each clothing hook 65 for convenient storage thereof. Clothing items such as pants (not shown) may be draped over the clothing support 35 for wrinkle-free storage thereof.

Referring to FIGS. 5-8, therein is shown a second embodiment extendible garment hanger 83 for hanging up the clothing items that includes a second version body 86 and a pair of slidable second version extension arms 89.

The body 86 includes an upright hook 92 from which a pair of shoulder supports 95 are oppositely laterally downwardly dependent, and a straight clothing support 98 that interconnects the shoulder supports 95, and a pair of clothing hooks 101 all of which are preferably integrally molded together from the plastic material. The shoulder supports 95 and the clothing support 98 form a rounded triangular shape. Each shoulder support 95 has a slide groove 104 in which one extension arm 89 is closely receivable and retained therein by a pair of retaining loops 107 with respective grooves 110. The grooves 104 and 110 preferably are each of semi-circular cross-section that together form a circular cross-section, though other formed cross-sections are possible such as circular, oval, polygonal, tee, and mushroom. The grooves 104 and 110 are coaxially disposed to closely receive and retain the extension arms 89 to the body 86. The extension arms 89 are frictionally retained within the grooves 104 and 110 to provide the infinite number of the longitudinal positions along the shoulder supports 95 to optimally receive and support the clothing items of the various shoulder widths. The retaining loops 107 may have respective longitudinal slots 113 through which the extension arms 89 snap-fit to facilitate assembly thereof into the grooves 104 and 110.

Each extension arm 89 is of a bent wire construction that includes a slide section 115 that is closely receivable within the grooves 104 and 110 of the shoulder support 95. A finger tab in the form of a finger loop 119 is upwardly dependent from an upwardly angled proximal end 122 thereof. A curved end support 125 is downwardly dependent from a distal end 128 thereof. The slide section 115, the finger loop 119, and the end support 125 are all preferably integrally bent from a suitable metal wire material.

The extension arms 89 may be inserted through the retaining loops 107 in the grooves 104 and 110 of the shoulder supports 95 prior to bending the end supports 125. Alternatively, they may snap-fit to respective of the shoulder supports 95 by pressing them through the slots 113 of the retaining loops 107 into the grooves 104 and 110. The extension arms 89 can be removed from the body 86 by reversing the particular procedure.

The garment hanger 83 is used like the non-extendible garment hangers except that the extension arms 89 are manually extended or retracted to the longitudinal positions by moving the finger loops 119 to the infinite number of longitudinal positions such that the end supports 125 fit the width of the clothing item. The other clothing item such as the tie, the brassier, or the like can be hung from each clothing hook 101 for convenient storage thereof. The clothing items such as the pants may be draped over the clothing support 98 for wrinkle-free storage thereof.

Referring to FIGS. 9-12, therein is shown a third embodiment extendible garment hanger 131 for hanging up the clothing items that includes a third version body 134 and a pair of slidable third version extension arms 137.

The body 134 includes an upright hook 140 from which a pair of shoulder supports 143 are oppositely laterally downwardly dependent, a gusset 144 that interconnects the hook 140 and the shoulder supports 143, a clothing hook 145 downwardly dependent from one shoulder support 143, and a straight clothing support 146 that interconnects the shoulder supports 143 all of which are preferably integrally molded together from the plastic material. The shoulder support 143 along with the clothing support 146 form the rounded triangular shape. Each shoulder support 143 has a slide bore 149 in which one extension arm 137 is closely receivable and an adjoining tab slot 152 disposed radially upwardly thereof. The slide bores 149 are preferably of a circular cross-section, though other cross-sections are possible such as oval, polygonal, tee, and mushroom. The extension arms 137 may be frictionally retained within the slide bores 149 to provide an infinite number of longitudinal positions along the shoulder supports 143 to optimally receive and support the clothing items of the various shoulder widths. Alternatively, a plurality of spaced detents 155 may be provided that are disposed along the tab slots 152 to retain the extension arms 137 in a finite number of predetermined longitudinal positions.

Each extension arm 137 is of the bent wire construction that includes a slide section 158 that is closely receivable within the slide bore 149 of the shoulder support 143. A finger tab in the form of a finger loop 161 is upwardly dependent from a proximal end 164 thereof. A curved end support 167 is downwardly dependent from a distal end 170 thereof. The slide section 158, the finger loop 161, and the end support 167 are all preferably integrally bent from the metal wire material of the circular cross-section. The finger loop 161 fits through the tab slot 152.

The extension arms 137 may be inserted into the arm holes 149 of the shoulder supports 143 prior to bending the end supports 167. The extension arms 137 can be removed from the body 134 by reversing the procedure.

The garment hanger 131 is used like the non-extendible garment hangers except that the extension arms 137 are manually extended or retracted to the longitudinal positions by moving the finger loops 161 to the infinite number of longitudinal positions or to the predetermined positions as determined by the detents 155 such that the end supports 167 fit the width of the clothing item. The other clothing item such as the tie, the brassier, or the like can be hung from the clothing hook 145 for convenient storage thereof. The clothing items such as the pants may be draped over the clothing support 146 for wrinkle-free storage thereof.

Referring to FIGS. 13-16, therein is shown a fourth embodiment extendible garment hanger 173 for hanging up the clothing items that includes a fourth version body 176 and a pair of slidable fourth version extension arms 179.

The body 176 includes an upright hook 182 from which a pair of shoulder supports 185 are oppositely laterally downwardly dependent, and a straight clothing support 188 that interconnects the shoulder supports 185 all of which are preferably integrally molded together from the plastic material. The shoulder supports 185 and the clothing support 188 form the rounded triangular shape. Each shoulder support 185 has a slide groove 191 in which one extension arm 179 is closely receivable and retained therein by a pair of retaining loops 194 with respective grooves 195. The grooves 191 and 195 preferably together form a mushroom cross-section, though other formed cross-sections are possible such as circular, oval, polygonal, and tee. The grooves 191 and 195 closely receive and retain the extension arms 179 to the body 176. The extension arms 179 are frictionally retained within the grooves 191 and 195 to provide the infinite number of the longitudinal positions along the shoulder supports 185 to optimally receive and support the clothing items of the various shoulder widths. The retaining loops 194 may have respective longitudinal slots 197 through which the extension arms 179 snap-fit to facilitate assembly thereof into the grooves 191 and 195.

Each extension arm 179 is of the plastic construction that includes a slide section 200 that is closely receivable within the grooves 191 and 195 of the shoulder support 185. A finger tab 203 is upwardly dependent from a proximal end 206 thereof reinforced with a gusset 209. A curved end support 212 is downwardly dependent from a distal end 215 thereof. The slide section 200, the finger tab 203, the gusset 209, and the end support 212 are all preferably integrally molded together from the plastic material.

The extension arms 179 may be inserted through the retaining loops 194 in the slide grooves 191 of the shoulder support 185 prior to heat-forming the end supports 212. Alternatively, they may snap-fit to respective of the shoulder supports 185 by pressing them through the slots 197 of the retaining loops 194 into the slide groove 191. The extension arms 179 can be removed from the body 176 by reversing the particular procedure.

The garment hanger 173 is used like the non-extendible garment hangers except that the extension arms 179 are manually extended or retracted to the longitudinal positions by moving the finger tabs 203 to the infinite number of longitudinal positions such that the end supports 212 fit the width of the clothing item. The clothing items such as the pants may be draped over the clothing support 188 for wrinkle-free storage thereof.

Referring to FIGS. 17-20, therein is shown a fifth embodiment extendible garment hanger 218 for hanging up the clothing items that includes a fifth version body 221 and a pair of slidable fifth version extension arms 224.

The body 221 includes an upright hook 227 from which a pair of shoulder supports 230 are oppositely laterally downwardly dependent, and a straight clothing support 233 that interconnects the shoulder supports 230 all of which are preferably integrally molded together from the plastic material. The shoulder support 230 and the clothing support 233 form a triangular shape. Each shoulder support 230 has a slide bore 236 in which one extension arm 224 is closely receivable and an adjoining tab slot 239 disposed radially upwardly thereof. The slide bores 236 are preferably of a circular cross-section, though other cross-sections are possible such as oval, polygonal, tee, and mushroom. The extension arms 224 may be frictionally retained within the slide bores 236 to provide an infinite number of longitudinal positions along the shoulder supports 230 to optimally receive and support the clothing items of the various shoulder widths. Alternatively, a plurality of spaced detents 242 may be provided that are disposed along the tab slots 239 to retain the extension arms 224 in a finite number of predetermined longitudinal positions.

Each extension arm 224 is of a combined plastic and bent wire construction that includes a slide section 248 that is closely receivable within the slide bore 236 of the shoulder support 230. A finger tab in the form of a right-angle finger extension 251 covered by a finger cap 254 is upwardly dependent from a proximal end 257 thereof A curved end support in the form of a clothing hook 260 is downwardly dependent from a distal end 263 thereof. The slide section 248 and the finger extension 251 are preferably integrally bent from the metal wire material of the circular cross-section. The finger extension 251 fits through the tab slot 239. Each finger cap 254 is preferably of frusto-conical shape with a bottom bore 266 into which the finger extension 251 is affixed. Each clothing hook 260 has an anchor bore 269 in which the distal end 263 of the slide section 248 is affixed. The finger caps 254 and the clothing hooks 260 are preferably separately molded from the plastic material.

The slide sections 245 of the extension arms 224 may be inserted into the slide bores 236 of the shoulder supports 230 prior to affixing the clothing hooks 260. The extension arms 224 can be removed from the body 221 by reversing the procedure.

The garment hanger 218 is used like the non-extendible garment hangers except that the extension arms 224 are manually extended or retracted to the longitudinal positions by moving the finger loops 257 to the infinite number of longitudinal positions or to the predetermined positions as determined by the detents 242 such that the clothing hooks 260 fit the width of the clothing item. The other clothing item such as the tie, the brassier, or the like can be hung from the clothing hooks 260 for convenient storage thereof. The clothing items such as the pants may be draped over the clothing support 233 for wrinkle-free storage thereof.

Referring to FIGS. 21-24, therein is shown a sixth embodiment extendible garment hanger 272 for hanging up the clothing items that includes a sixth version body 275 and a pair of sixth version extension arms 284.

The body 275 includes an upright hook 287 from which a pair of shoulder supports 290 are oppositely laterally downwardly dependent, and a semi-U-shaped clothing support 293 downwardly dependent from and that interconnects the shoulder supports 290 all of which are preferably integrally molded together from a suitable plastic material. The clothing support 293 includes a pair of horizontally spaced connecting sections 296 downwardly dependent from the shoulder supports 290 with lower ends 299 affixed to opposite ends 302 of a horizontally disposed support section 305. The shoulder supports 290 and the clothing support 293 form a rounded, semi-triangular shape.

The shoulder supports 290 comprise a pair of stub arms 308 dependent from the hook 287 and a pair of extension tubes 311. The hook 287 and the stub arms 308 are preferably integrally molded together from the plastic material. The extension tubes 311 are preferably molded or extruded from the plastic material. Each extension tube 311 has a slide bore 314 in which one stub arm 308 is affixed and in which one extension arm 284 is closely receivable, and an adjoining tab slot 317 disposed radially upwardly thereof. The slide bores 314 are preferably of a circular cross-section, though other cross-sections are possible such as oval, polygonal, tee, and mushroom. The extension arms 284 may be frictionally retained within the slide bores 314 to provide an infinite number of longitudinal positions along the shoulder supports 290 to optimally receive and support the clothing items of the various shoulder widths. Alternatively, a plurality of spaced detents 329 may be provided that are disposed along the tab slots 317 to retain the extension arms 284 in a finite number of predetermined longitudinal positions.

Each extension arm 284 is of a plastic construction that includes a slide section 332 that is closely receivable within the slide bore 314 of the extension tubes 311. A curved finger tab 335 is upwardly dependent from a proximal end 338 thereof. A curved end support in the form of a clothing hook 341 is downwardly dependent from a distal end 344 thereof. The slide section 332, the finger tab 335, and the clothing hook 341 are all preferably integrally molded together from the plastic material. The finger tab 335 fits through the tab slot 317.

The slide sections 332 of the extension arms 284 are inserted into the slide bores 314 of the extension tubes 311 prior to affixing the finger tabs 335. The extension arms 284 can be removed from the body 275 by reversing the procedure.

The garment hanger 272 is used like the non-extendible garment hangers except that the extension arms 284 are manually extended or retracted to the longitudinal positions by moving the finger tabs 335 to the infinite number of longitudinal positions or to the predetermined positions as determined by the detents 329 such that the clothing hooks 341 fit the width of the clothing item. The other clothing item such as the tie, the brassier, or the like can be hung from the clothing hook 341 for convenient storage thereof. The clothing items such as the pants may be draped over the clothing support 293 for wrinkle-free storage thereof.

Referring to FIGS. 25-28, therein is shown a seventh embodiment extendible garment hanger 320 for hanging up the clothing items that includes a seventh version body 323 and a pair of slidable seventh version extension arms 326.

The body 323 includes an upright hook 329 from which a pair of shoulder supports 332 are oppositely laterally downwardly dependent, a triangular indicia plate 335 having an indicia 338, and a semi-U-shaped clothing support 341 downwardly dependent from and that interconnects the shoulder supports 332 all of which are preferably integrally molded together from the suitable plastic material. The clothing support 341 includes a pair of horizontally spaced connecting sections 342 downwardly dependent from the shoulder supports 332 with lower ends 343 affixed to opposite ends 344 of a horizontally disposed support section 345. The shoulder supports 332, the indicia plate 335, and the clothing support 341 form a rounded, semi-triangular shape. Each shoulder support 332 has an slide bore 346 in which one extension arm 326 is closely receivable and an adjoining tab slot 347 disposed radially forwardly thereof. The slide bores 346 are preferably of a circular cross-section, though other cross-sections are possible such as oval, polygonal, tee, and mushroom. The tab slot 347 has an elongated main section 350 that extends from a proximal end 353 thereof and terminates at a laterally wider distal end 356. The extension arms 326 may be frictionally retained within the slide bores 346 to provide an infinite number of longitudinal positions along the shoulder supports 332 to optimally receive and support the clothing items of the various shoulder widths. Alternatively, a plurality of spaced detents 359 may be provided that are disposed along the tab slots 347 to retain the extension arms 326 in a finite number of predetermined longitudinal positions.

Each extension arm 326 is of a plastic construction that includes a slide section 365 that is closely receivable within the slide bore 344 of the shoulder support 332. A finger tab 368 is upwardly dependent from a longitudinally tapered proximal end 371 thereof. A curved end support in the form of a clothing hook 374 is downwardly dependent from a distal end 377 thereof. The slide section 365, the finger tab 368, and the clothing hook 374 are all preferably integrally molded together from the plastic material. The finger tab 368 has an enlarged head 380, preferably of a smooth, low clothing-friendly profile, connected to the slide section 365 through a laterally narrower neck 383. A transverse slot 386 divides the finger tab 368 into a non-flexible proximal end 389 and a flexible retaining tab 392 that releasibly snap-locks the extension arm 326 to the body 323. The finger tab 368 fits through the distal end 356 of the tab slot 347. The neck 383 of the finger tab 368 closely slidably fits within the main section 350 of the tab slot 347. The finger tab 368 is asably retained within the detents 359 of the tab slot 347.

The extension arms 326 fit into the slide bores 344 of the shoulder supports 332 by slightly tilting the extension arm 326 slightly off of coaxial with the shoulder support 332 as shown in FIG. 28. As the finger tab 368 and the proximal end 371 of the extension arm 326 are slid into the slide bore 344 of the shoulder support 332 they move towards a coaxial orientation. However, the retaining tab 386 of the finger tab 368 prohibits further movement to the coaxial orientation until a slight longitudinally-directed hand-force is applied to the shoulder support 332 to downwardly deflect the retaining tab 386 thereof so the finger tab 368 enters the distal end 356 of the tab slot 347. This locks the extension arm 326 to the body 323. The extension arm 326 can be removed from the body 323 by manually laterally deflecting the retaining tab 386 and reversing the procedure.

The garment hanger 320 is used like conventional, non-extendible garment hangers except that the extension arms 326 are manually extended or retracted by moving the finger tabs 368 to the infinite number of longitudinal positions or to the predetermined positions as determined by the detents 359 to such that the clothing hooks 374 fit the width of the clothing item. The other clothing items can be hung from each clothing hook 374 for convenient storage thereof. The clothing items such as the pants may be draped over the clothing support 341 for wrinkle-free storage thereof.

Referring to FIGS. 29-32, therein is shown an eighth embodiment extendible garment hanger 395 for hanging up the clothing items that includes an eighth version body 398 and a pair of slidable eighth version extension arms 401.

The body 398 includes an upright hook 404 from which a pair of shoulder supports 407 are oppositely laterally downwardly dependent, an oval indicia plate 410 having an indicia 413, and a semi-U-shaped clothing support 416 downwardly dependent from and that interconnects the shoulder supports 407 all of which are preferably integrally molded together from the suitable plastic material. The clothing support 416 includes a pair of horizontally spaced connecting sections 419 downwardly dependent from the shoulder supports 407 with lower ends 422 affixed to opposite ends 425 of a horizontally disposed support section 428. The shoulder supports 407, the indicia plate 413, and the clothing support 416 form a rounded, semi-triangular shape. Each shoulder support 407 has an slide bore 431 in which one extension arm 401 is closely receivable and an adjoining tab slot 434 disposed radially forwardly thereof. The slide bores 431 are preferably of a circular cross-section, though other cross-sections are possible such as oval, polygonal, tee, and mushroom. The tab slot 434 has an elongated main section 437 that extends from a proximal end 440 thereof and terminates at a laterally wider distal end 443. The extension arms 401 may be frictionally retained within the slide bores 431 to provide an infinite number of longitudinal positions along the shoulder supports 407 to optimally receive and support the clothing items of the various shoulder widths. Alternatively, a plurality of spaced holes 446 may be provided that are disposed along the shoulder supports 407 that releasably receive respective rounded locking tips 449 of the extension arms 401 to retain them in a finite number of predetermined longitudinal positions.

Each extension arm 401 is of a plastic construction that includes a slide section 452 that is closely receivable within the slide bore 431 of the shoulder support 407. A finger tab 455 is upwardly dependent from a longitudinally tapered proximal end 458 thereof. A curved end support in the form of a clothing hook 461 is downwardly dependent from a distal end 464 thereof. The slide section 452, the finger tab 455, and the clothing hook 461 are all preferably integrally molded together from the plastic material. The finger tab 455 has an enlarged head 467, preferably of a smooth, low clothing-friendly profile, connected to the slide section 452 through a laterally narrower neck 470. A transverse slot 473 divides the finger tab 455 into a non-flexible proximal end 476 and a flexible retaining tab 479 that releasably snap-locks the extension arm 401 to the body 398. The finger tab 455 fits through the distal end 443 of the tab slot 434. The neck 470 of the finger tab 455 closely slidably fits within the main section 437 of the tab slot 434.

The extension arms 401 fit into the slide bores 431 of the shoulder supports 407 by slightly tilting the extension arm 401 slightly off of coaxial with the shoulder support 407 as shown in FIG. 32. As the finger tab 455 and the proximal end 458 of the extension arm 401 are slid into the slide bore 431 of the shoulder support 407 they move towards a coaxial orientation. However, the retaining tab 479 of the finger tab 455 prohibits further movement to the coaxial orientation until a slight longitudinally-directed hand-force is applied to the shoulder support 407 to downwardly deflect the retaining tab 479 thereof so the finger tab 455 enters the distal end 443 of the tab slot 434. This locks the extension arm 401 to the body 398. The extension arm 401 can be removed from the body 398 by manually laterally deflecting the retaining tab 479 and reversing the procedure.

The garment hanger 395 is used like conventional, non-extendible garment hangers except that the extension arms 401 are manually extended or retracted by moving the finger tabs 455 to the infinite number of longitudinal positions or to the predetermined positions as determined by the holes 446 such that the clothing hooks 461 fit the width of the clothing item. The other clothing items can be hung from each clothing hook 461 for convenient storage thereof. The clothing items such as the pants may be draped over the clothing support 416 for wrinkle-free storage thereof.

The extendible garment hangers of the present invention thus solve the serious shortcomings of the prior art adjustable garment hangers by: 1) being rigid and sturdy enough to hold heavier clothing articles such as the sweaters; 2) being inexpensive to manufacture; 3) smoothly engaging the clothing article to eliminate creating the wrinkles and deformities; 4) allowing hanging up of additional clothing articles such the brasiers, ties, belts, pants, and the like; and 5) retaining the desired position to fit the shoulder width of the clothing article, that solves the shortcomings in the prior art garment hangers.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An extendible garment hanger for clothing items having shoulders of differing widths, comprising:

a body that includes an upright hook from which a pair of shoulder supports are oppositely laterally downwardly dependent;

a pair of extension arms each including a slide section slidably mounted along one of said shoulder supports having a proximal end with an upright finger tab and a distal end with a downwardly curved end support; and wherein said extension arms are manually positionable in a plurality of longitudinal positions along said shoulder supports by moving said finger tab such that said end supports fit the width of the clothing item;

wherein each shoulder support has a slide bore in which the slide section of one extension arm is closely receivable and an adjoining tab slot through which the finger tab slidably extends; and wherein the proximal ends of the extension arms are longitudinally tapered radially opposite the finger tabs to facilitate assembly into the slide bores.

2. The garment hanger of claim 1, wherein the body includes a clothing support that interconnects the shoulder supports.

3. The garment hanger of claim 1, wherein the body includes at least one of an indicia plate, a gusset, and a clothing hook.

4. The garment hanger of claim 1, wherein at least one end support comprises a clothing hook.

5. The garment hanger of claim 1, wherein each tab slot is disposed in a radial position along the shoulder support chosen from the group consisting of upwardly and forwardly.

6. The garment hanger of claim 1, wherein the tab slot comprises one or more detents.

7. The garment hanger of claim 1, wherein a transverse slot divides the finger tab into a non-flexible proximal end and a flexible retaining tab adapted to releasably snap-lock the extension arm to the body.

8. The garment hanger of claim 1, wherein each finger tab has an enlarged head connected to the slide section through a laterally narrower neck, and the tab slot has an elongated main section that terminates at a laterally wider distal end respectively through which said neck and said finger tab closely fit.

9. The garment hanger of claim 8, wherein the head of the finger tab has a clothing-friendly profile.

10. The garment hanger of claim 1, wherein the slide sections of the retaining arms are of a cross-section chosen from the group consisting of circular, oval, polygonal, tee, and mushroom.

11. The garment hanger of claim 1, wherein the extension arms are of a construction chosen from the group consisting of plastic, bent wire, and a combination thereof.

12. The garment hanger of claim 1, wherein the finger tabs are of a configuration chosen from the group consisting of a finger loop and a right-angle finger extension covered by a finger cap.

13. An extendible garment hanger for clothing items having shoulders of differing widths, comprising:

a plastic body that includes an upright hook from which a pair of shoulder supports are oppositely laterally downwardly dependent that are interconnected by a clothing support, each shoulder support having a slide bore and an adjoining tab slot along which a plurality of tab receiving detents are disposed;

a pair of extension arms including a slide section of a cross-section chosen from the group consisting of circular, oval, and polygonal closely slidably receivable within said slide bore of one of said shoulder supports, said slide sections each having a proximal end with an upright finger tab and a distal end with a downwardly curved end support; and wherein said extension arms are manually positionable in a finite plurality of longitudinal positions along said shoulder supports by moving said finger tabs along said tab slots into said tab-receiving detents such that said end supports fit the width of the clothing item; and wherein the tab slots each have an elongated main section along which the tab-receiving detents are disposed that terminates at a laterally wider distal end, the extension arms comprise slide sections being of the circular cross-section, the proximal end of each slide section being longitudinally tapered radially opposite the finger tab to facilitate assembly into the slide bores.

14. The garment hanger of claim 13, wherein the body is integrally molded and has a centrally disposed clothing hook dependent from one of the shoulder supports, the extension arms being of the circular cross-section, and the finger tabs each comprise a finger loop.

15. The garment hanger of claim 13, wherein the body is integrally molded, the slide sections being of the circular cross-section, the shoulder supports comprise clothing hooks, and the finger tabs each comprise a right-angle finger extension covered by a finger cap.

16. The garment hanger of claim 13, wherein the shoulder supports comprise a pair of stub arms dependent from the hook and a pair of extension tubes each having the slide bore into which respective of said stub arms are coaxially affixed and the tab slot along which the tab-receiving detents are disposed, the clothing support has a generally horizontally disposed support section, the slide sections being of the circular cross-section, the end support comprises a clothing hook, and the finger tab is curved.

17. An extendible garment hanger for clothing items having shoulders of differing widths, comprising:

an integrally molded plastic body that includes an upright hook from which a pair of shoulder supports are oppositely laterally downwardly dependent that are interconnected by a horizontally disposed clothing support, each shoulder support having a slide groove and at least one retaining loop;

a pair of extension arms each including a slide section of a cross-section chosen from the group consisting of circular, oval, polygonal, tee, and mushroom closely slidably receivable within said slide groove of one of said shoulder supports retained therein by said retaining loop, said slide sections each having a proximal end with an upright finger tab and a distal end with a downwardly curved end support, each finger tab being of a configuration chose from the group consisting of a finger loop and a right-angle finger extension covered by a finger cap;

wherein said extension arms are manually positionable in an infinite plurality of longitudinal positions along said shoulder supports using friction by moving said finger tabs along said tab slots such that said end supports fit the width of the clothing item; and wherein the body includes a pair of horizontally spaced clothing hooks dependent from respective of the shoulder supports, and the slide sections are of the circular cross-section and the finger tab comprises the finger loop.

18. The garment hanger of claim 17, wherein the extension arms are of the plastic construction with the slide sections being of the mushroom cross-section.

19. An extendible garment hanger comprising:

a body that includes an upright hook and a pair of shoulder supports;

a pair of extension arms having a proximal end and a distal end, each extension arm comprising a retaining member;

wherein said extension arms are positionable in a plurality of longitudinal positions along said shoulder supports;

wherein each shoulder support has an opening for receiving one extension arm and a receiver through which the retaining member extends;

wherein the proximal ends of the extension arms are longitudinally tapered radially opposite the retaining members to facilitate assembly into the opening of the shoulder supports; and wherein the retaining members each comprise a finger tab having an enlarged head, and the receiver has an elongated main section that terminates at a laterally wider distal end through which said finger tab closely fit.

20. The extendible garment hanger of claim 19, wherein the extension arms are slidably received by the shoulder supports.

21. The extendible garment hanger of claim 19, wherein the extension arms are frictionally retained in the opening of the shoulder supports.

22. The extendible garment hanger of claim 19, wherein each retaining member is disposed in a radial position along the shoulder support chosen from the group consisting of upwardly and forwardly.

23. The extendible garment hanger of claim 19, wherein the receiver is a slot or a plurality of detents.

24. The garment hanger of claim 19, wherein the retaining members are of a configuration selected from the group consisting of a finger tab, finger loop, and a right-angle finger extension covered by a finger cap.

25. The garment hanger of claim 19, wherein the extension arms are of a cross-section chosen from the group consisting of circular, oval, polygonal, tee, and mushroom.

26. An extendible garment hanger comprising:

a body that includes an upright hook and a pair of shoulder supports;

a pair of extension arms having a proximal end and a distal end, each extension arm comprising a retaining member;

wherein said extension arms are positionable in a plurality of longitudinal positions along said shoulder supports;

wherein each shoulder support has an opening for receiving one extension arm and a receiver through which the retaining member extends; and wherein the proximal ends of the extension arms are longitudinally tapered radially opposite the retaining members to facilitate assembly into the opening of the shoulder supports; and wherein a transverse slot divides the retaining member into a non-flexible proximal end and a flexible retaining member adapted to releasably snap-lock the extension arm to the body.

* * * * *